United States Patent [19]

Forrest

[11] 4,209,187

[45] Jun. 24, 1980

[54] BOOK COVER

[76] Inventor: Richard E. Forrest, 98 Riverside Dr., New York, N.Y. 10024

[21] Appl. No.: 894,981

[22] Filed: Apr. 10, 1978

[51] Int. Cl.[2] ..... B42D 3/04

[52] U.S. Cl. ..... 281/19 R; 281/34; 281/35

[58] Field of Search ..... 281/29, 34, 35, 19; 29/407

[56] References Cited

U.S. PATENT DOCUMENTS

| | | | |
|---|---|---|---|
| 1,354,354 | 9/1920 | Toland | 281/34 |
| 3,241,863 | 3/1966 | Paddack | 281/29 |

FOREIGN PATENT DOCUMENTS

| | | | |
|---|---|---|---|
| 1960437 | 6/1971 | Fed. Rep. of Germany | 281/34 |
| 404445 | 1/1934 | United Kingdom | 281/34 |
| 452325 | 8/1936 | United Kingdom | 281/34 |
| 1467868 | 3/1977 | United Kingdom | 281/34 |

*Primary Examiner*—John McQuade
*Attorney, Agent, or Firm*—Thomas R. Morrison

[57] ABSTRACT

A book cover for paperback volumes has folded-in longitudinal flaps at two opposed edges thereof. Each flap fits into two slits at the junction of the cover and the spine to lock the book into the cover. Optional reinforcing boards may be used.

10 Claims, 5 Drawing Figures

BOOK COVER

BACKGROUND OF THE INVENTION

A large class of books is made with a single-layer paper cover glued or otherwise attached to the spine. These are commonly referred to as a paperback book. Many of the paperback books in current use experience long term retention and use. For example, college textbooks, telephone directories and many others may remain in use for months or years under constant handling. It is common experience that the covers of paperback books soon become frayed, tattered, torn, stained or removed completely.

The prior art contains a number of attempts to provide covering and reinforcement for paperback book covers. Typical of these attempts are the inventions disclosed in U.S. Pat. Nos. 3,140,883; 3,165,337; 3,241,863; 3,572,767 and 3,915,778 in which the original paper cover of a book is fitted into an envelope-type pocket usually sealed on three edges and sometimes reinforced with a reinforcing board. In some of these patents, the two pockets are independently slipped over the front and back covers and are held in place by adhesive tape bonding to the book or bonding to each other.

SUMMARY OF THE INVENTION

The present invention teaches a reinforcing book cover which converts a paperback book into a casebound book in which the spine of the book is supported by a peripheral strip of the reinforcing cover.

A short slit is formed at the junction of the cover and the spine of the paperback book at each of the four corners thereof. A peripheral flap of the reinforcing cover is slipped through the two slits at one edge of the book and overlays the inner perimeter of one edge of the two covers and a second peripheral flap is similarly slipped into the slits at the other edge of the book and overlays the inner perimeter of the second edge of the two covers. Reinforcing boards may be placed between the original book cover and the book to form a hardbound volume.

The inner edge of each reinforcing board is held against the junction of the cover and the seam to help lock the assembly together.

At least one end of the reinforcing cover is closed after assembly of the book in the reinforcing cover in order to lock the entire book and reinforcing cover together.

DETAILED DESCRIPTION OF THE PREFERRED EMBODIMENT

Figure 1:
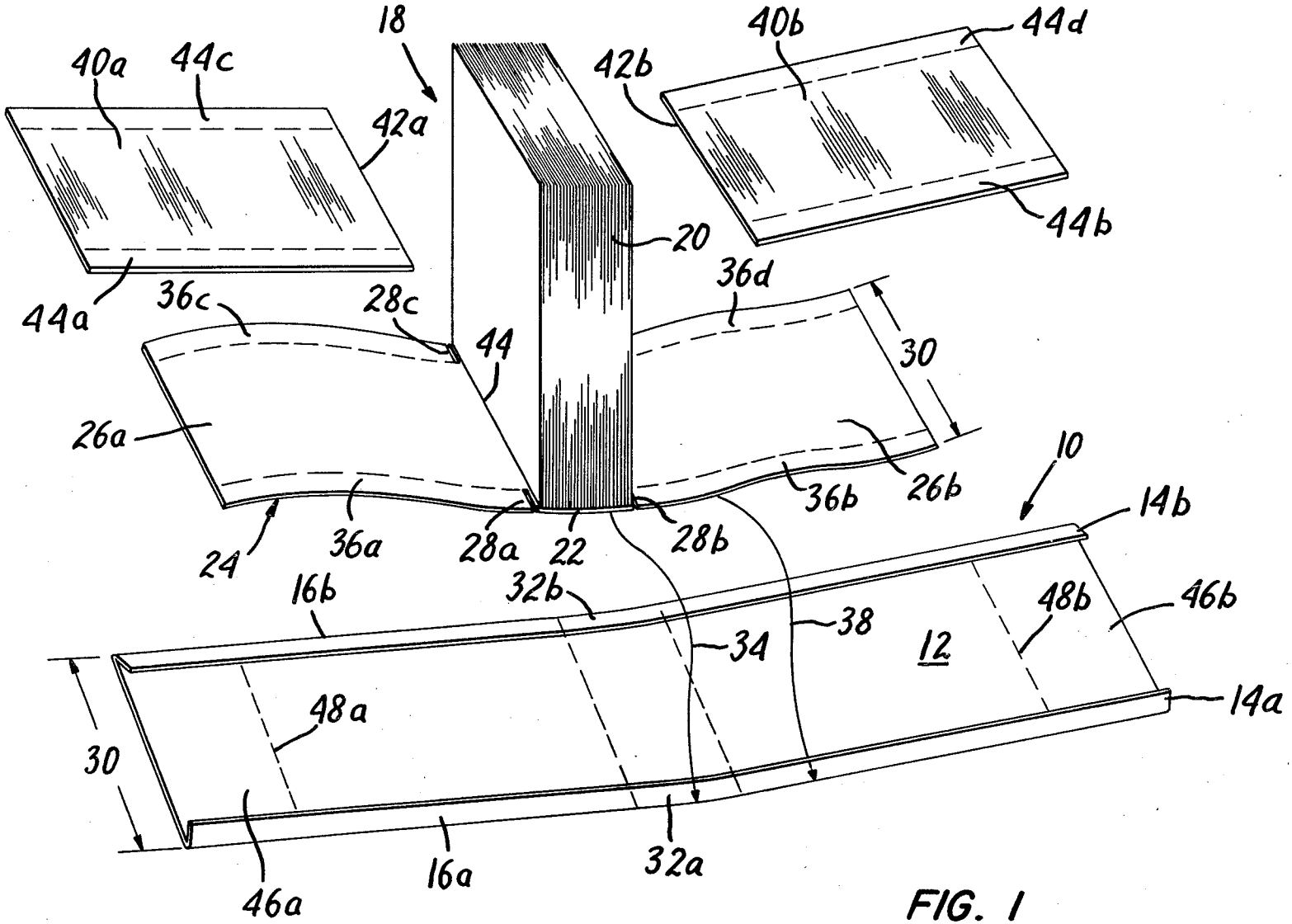
FIG. 1 shows a first embodiment of the present invention.

Referring now to FIG. 1, there is shown, generally at 10 an embodiment of the reinforcing book cover of the present invention. In this embodiment, the reinforcing book cover 10 is a single sheet of creasable material having a main panel 12 and longitudinal peripheral flaps 14*a*, 14*b* along the long edges of the main panel 12 formed by creasing the material at 16*a*, 16*b*.

A book 18, of the type generally referred to as a paperback book, having a plurality of pages 20 usually united at one edge of the spine 22 by means well known in the art and not described in detail but which may encompass gluing, sewing or stapling or other means, is shown adjacent to the reinforcing book cover. A paperback cover 24 is attached by means well known in the art such as gluing to the spine 22 leaving flexible flaps 26*a* and 26*b* which normally fold against the front and back of the pages 20 to serve as a protective cover for the book 18. When thus held in their protective positions, the flexible flaps 26*a* and 26*b* are usually congruent and coextensive with the pages 20.

The paperback book 18 is prepared for covering by forming four slits 28*a*, 28*b*, 28*c* and 28*d* (28*d* hidden by other parts) adjacent each of the four corners of the spine 22 where the flexible flaps 26*a*, 26*b* join the spine 22. The slits 28*a*, 28*b*, 28*c* and 28*d* are preferably slightly longer than the width of the longitudinal peripheral flaps 14*a* and 14*b*.

The dimension 30 shown between the insides of the creases 16*a* and 16*b* is slightly less than the dimension 30 shown for the width of flexible flaps 26*a* and 26*b*.

To cover the book 18, the spine 22 is placed upon flaps 14*a* and 14*b* in an approximately central location shown as 32*a*, 32*b* and as indicated by the arrow 34. Longitudinal perimeter strips 36*a*, 36*b*, 36*c* and 36*d* are slipped under flaps 14*a* and 14*b* as indicated by arrow 38 with the longitudinal peripheral flap 14*a* passing through slits 28*a* and 28*b* and longitudinal peripheral flap 14*b* passing through slits 28*c* and 28*d* (28*d* hidden). Since the dimension 30 of the flexible flaps 26*a* and 26*b* is approximately equal to the dimension 30 inside the creases 16*a* and 16*b*, the book 18 is accurately and securely retained in the reinforcing book cover 10.

Reinforcing boards 40*a*, 40*b* of any convenient stiffening material such as plastic, wood, paper, cardboard or any other suitable material may optionally be inserted on top of the flexible flaps 26*a* and 26*b* as shown with the inner edges 42*a* and 42*b* respectively being snugly seated against the line 44 between the spine 22 and a flexible flap 26*a* and 26*b*. When the reinforcing boards 40*a* and 40*b* are thus inserted, the longitudinal peripheral flaps 14*a* and 14*b* of the reinforcing book cover overlaps longitudinal perimeter strips 44*a*, 44*b*, 44*c* and 44*d* of the reinforcing boards 40*a* and 40*b*.

The flexible flaps 26*a* and 26*b* of the book 18 may be attached to the reinforcing book cover 10 but are preferably left free to slide therein to permit relative motion therebetween during opening and closing of the book 18. When reinforcing boards 40*a* and 40*b* are used, they may be either temporarily or permanently affixed to the reinforcing book cover or they may be merely placed therein and held as will be explained.

Figure 2:
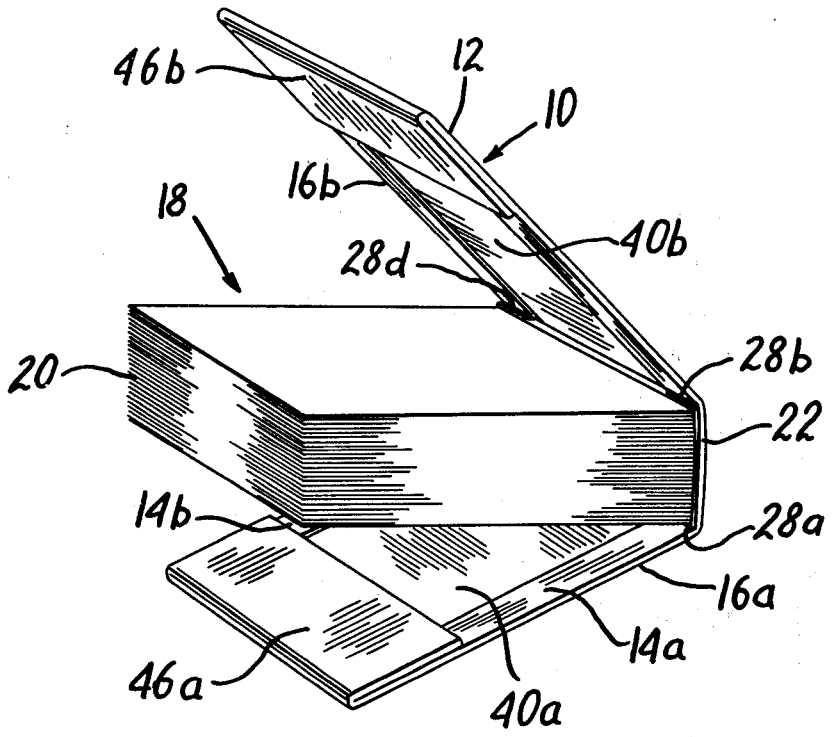
FIG. 2 shows a book covered with a reinforcing book cover according to one embodiment of the present invention.

Once the preceding assembly steps are completed, end flaps 46*a* and 46*b* of the reinforcing cover 10 are folded toward each other along the dashed lines 48*a* and 48*b* toward the pages 20 of the book 18. The end flaps 46*a* and 46*b* may optionally be secured in the folded position by means well known in the art such as gluing, taping, sewing or otherwise retaining the end flaps 46*a* and 46*b* in the folded position. Alternatively, the end flaps 46a and 46b may be merely folded as described in the preceding and held in place partly by the crease at fold lines 48a and 48b and partly by being held between the main panel 12 and the pages 20 of the book 18 in the closed position. FIG. 2 shows a book 18 thus covered.

Figure 3:
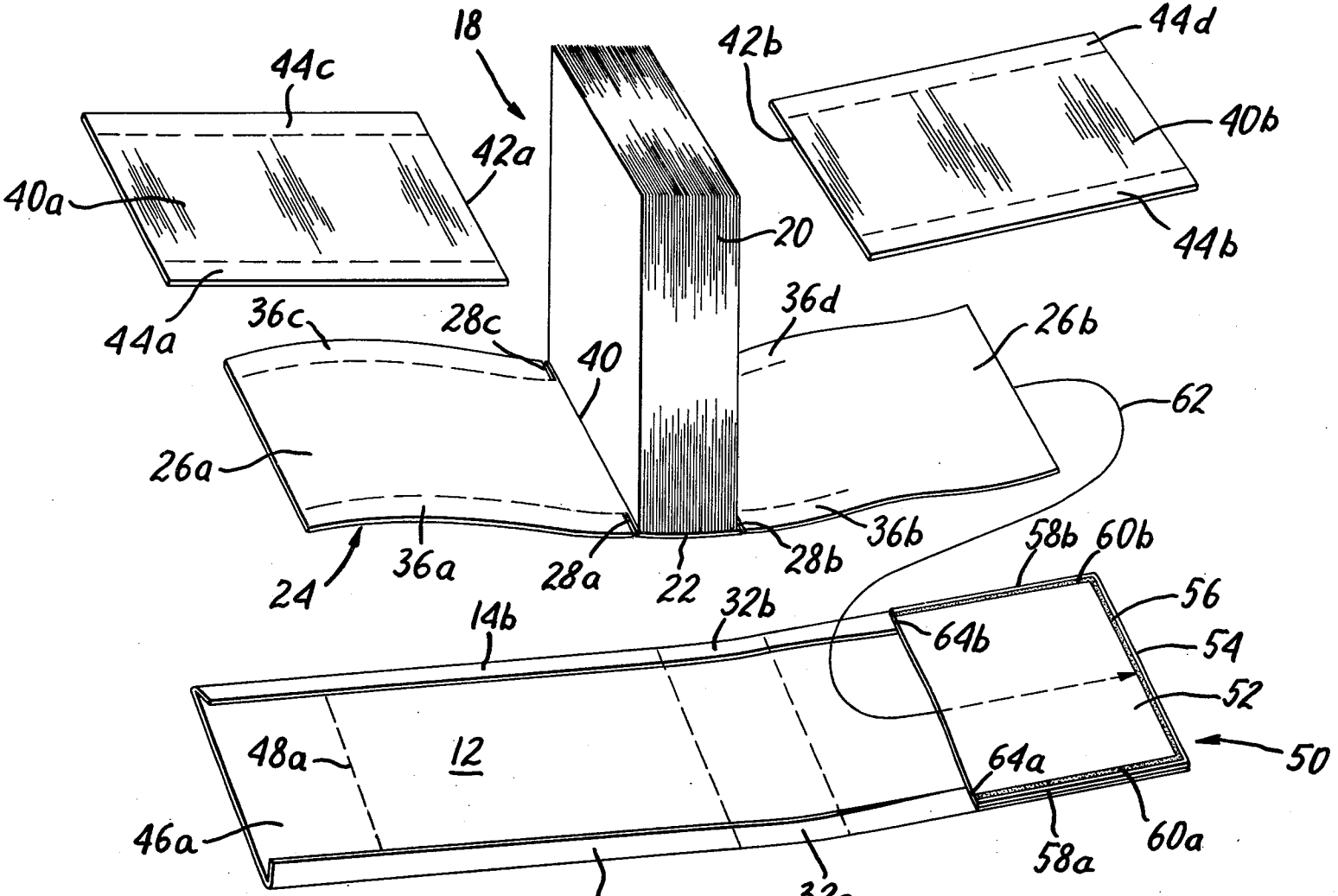
FIG. 3 shows a second embodiment of the invention employing one three-sided envelope-type pocket.

Referring now to FIG. 3, there is shown a second embodiment of the reinforcing book cover 50.

An envelope-type pocket is optionally sealed at its outer end 54 by a seam 56 and at its edges 58a and 58b by seams 60a and 60b respectively.

The flexible flap 26b is slipped under the envelope-type pocket 52 as indicated by the arrow 62 with the spine 22 resting on the areas 32a and 32b of the longitudinal peripheral flaps 14a and 14b and with the longitudinal perimeter strips 36a, 36b, 36c and 36d being under a longitudinal peripheral flaps 14a and 14b as in the previous embodiment except that under the envelope-type pocket 52, the longitudinal peripheral flaps 14a and 14b may optionally be omitted and the ends 64a and 64b of the longitudinal peripheral flaps 14a and 14b may optionally be attached to the edge of the envelope-type pocket 52.

The reinforcing board 40b may be inserted in the envelope-type pocket 52 before insertion of the flexible flap 26b thereinto. In this construction, the flexible flap 26b is inserted under the reinforcing board 40a. Alternatively, the reinforcing board 40b may be permanently affixed in the envelope-type pocket 52 using means well known in the art such as glue or adhesive tape. As in the preceding embodiment, end flap 46a may be folded over at fold line 48a to secure the other flexible flap 26a in position optionally using reinforcing board 40a.

Figure 4:
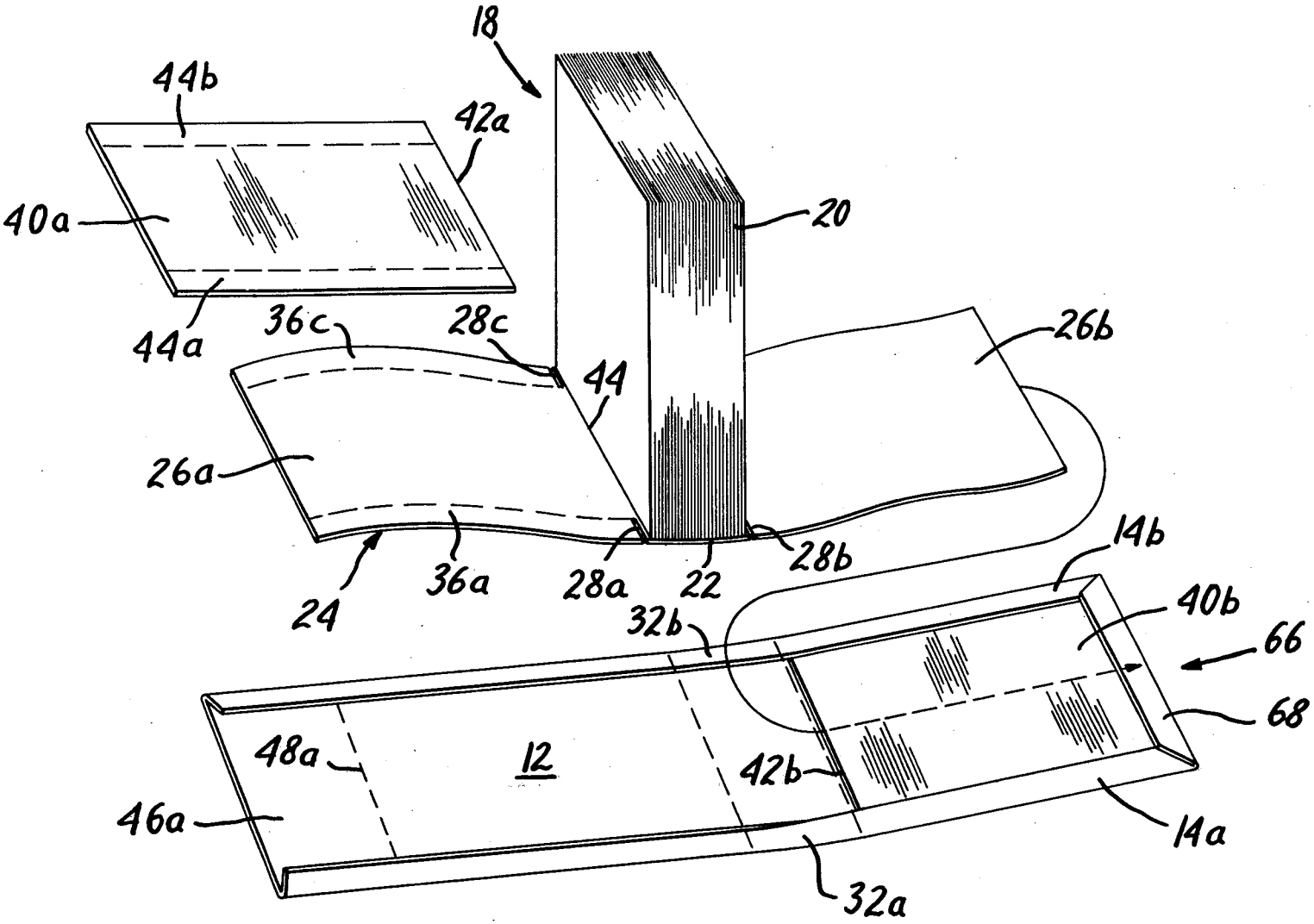
FIG. 4 shows a third embodiment of the invention in which one of the reinforcing boards is permanently affixed to create a three-sided envelope-type pocket.

Referring now to FIG. 4, there is shows a third embodiment of the reinforcing book cover 66.

Reinforcing board 40b is permanently secured under longitudinal peripheral flaps 14a and 14b by means well known in the art such as gluing and optionally, an end flap 68 of the main panel 12 is folded over the end of the reinforcing board 40b and is also secured to the reinforcing board 40b by means well known in the art such as gluing. The space between the reinforcing board 40b and the main panel 12 forms an envelope-type pocket similar to envelope-type pocket 52 shown in FIG. 3.

To cover and reinforce the book 18, the flexible flap 26b is slipped between the reinforcing board 40b and the main panel 12 and is moved up so that the edge of the spine 22 abuts the inner egde 42b of the reinforcing board 40b. As in previous embodiments, longitudinal peripheral flap 14a passes through slits 28a and 28b and longitudinal peripheral flap 14b passes through slits 28c and 28d (28d hidden).

Reinforcing board 40a may optionally be inserted under longitudinal peripheral flaps 14a and 14b atop the flexible flap 26a and the end flap 46a may be folded over the flexible flap 26a, optionally with reinforcing board 40a at fold line 48a. The end flap 46a may be optionally held in the folded position using fastening means well known in the art such as glue, tape or metallic or cloth fasteners. Optionally, the longitudinal peripheral flaps 14a and 14b may be attached to longitudinal perimeter strips 44a and 44c of the reinforcing board 40a using any fastening means known in the art such as glue or tape.

When longitudinal peripheral flaps 14a and 14b as well as end flaps 68 and 46a are glued or otherwise attached to reinforcing boards 40b and 40a respectively, there is no requirement that the material of the main panel 12 and longitudinal peripheral flaps 14a and 14b be of creasable material. For example, flexible cloth or other non-creasing material may be used. However, creasable materials such as paper, treated paper, plastic and the like may also be used in this embodiment.

Figure 5:
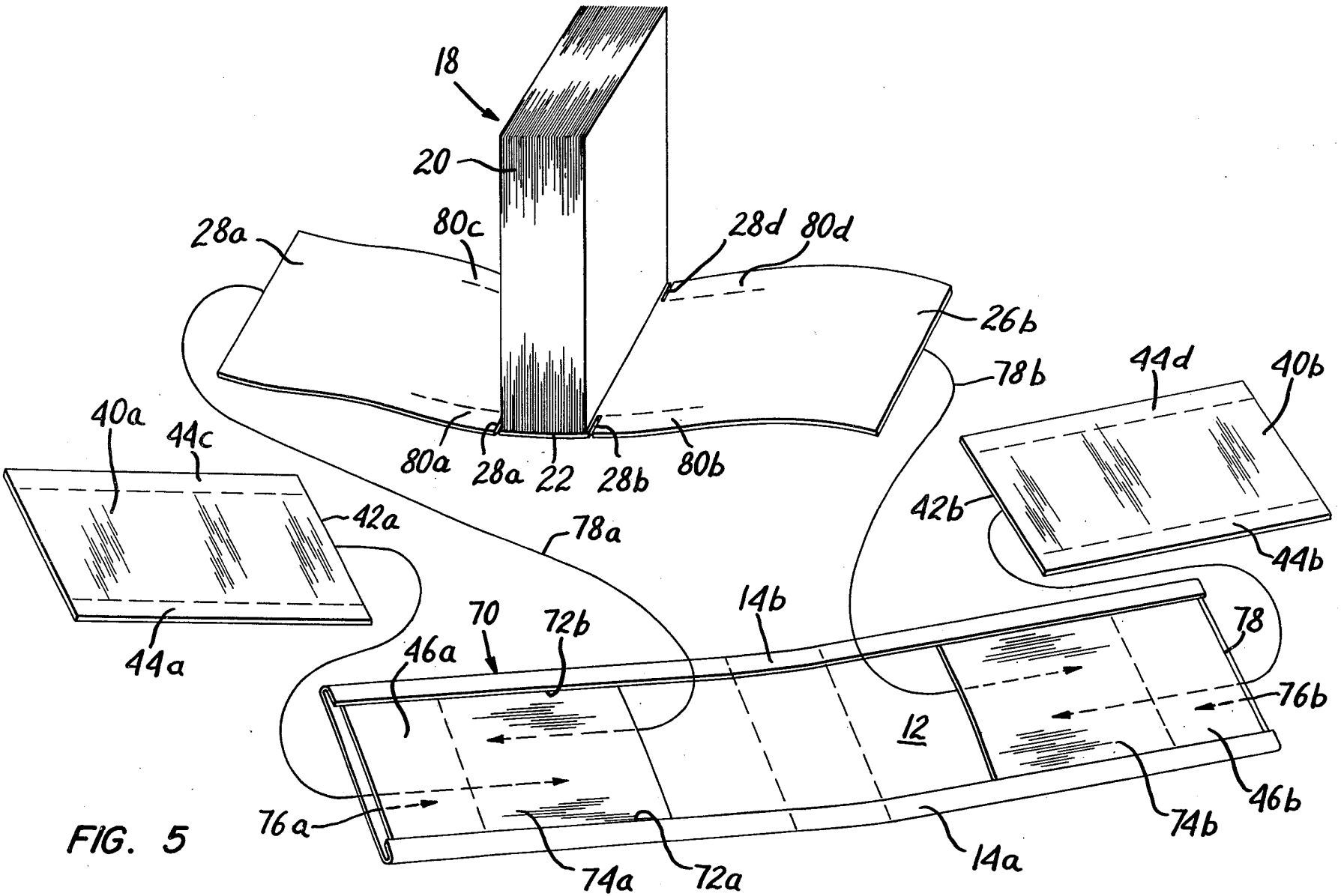
FIG. 5 shows a fourth embodiment of the invention employing two two-sided pockets.

A fourth embodiment of the reinforcing book cover 70 is shown in FIG. 5.

The longitudinal peripheral flaps 14a and 14b are joined along inner edges 72a and 72b to panels 74a and 74b thus creating open two-sided pockets 76a and 76b. At least one of the two-sides pockets, for example, two-sided pocket 76a, is open at both ends. The other two-sided pocket, for example 76b, may be closed at its outer end 78 or, alternatively it may be open at both ends.

To cover the book 18, the flexible flaps 26a and 26b are inserted into the two-sided pockets 76a and 76b as indicated by the arrow 78a and 78b respectively. As in previous embodiments, the spine 22 rests atop longitudinal peripheral flaps 14a and 14b, perimeter strips 80a and 80b are fitted below the longitudinal peripheral flap 14a and perimeter strips 80c and 80d are similarly fitted below longitudinal pripheral flap 14b with the longitudinal peripheral flaps 14a and 14b passing through the slits 28a, 28b, 28c and 28d.

Reinforcing boards 40a and 40b may optionally be inserted from the outer ends of two-sided pockets 76a and 76b between the flexible flaps 26a and 26b and panels 74a and 74b, all respectively. The reinforcing boards 40a and 40b are pushed inward until the inner edges 42a and 42b thereof are fitted snugly against the pages 20 of the book 18 adjacent to the spine 22. End flaps 46a and 46b may be folded inward to capture the reinforcing boards 40a and 40b as well as the flexible flaps 26a and 26b to lock the case-bound volume together.

Alternatively, the reinforcing book cover 70 may be fabricated with one of the reinforcing boards, for example, 40b permanently secured therein and with a sealed end similar to preceding embodiments. The other end of the reinforcing book cover 70 is preferably left open as shown in order to permit insertion of the reinforcing board 40a and the locking together of the entire assembly.

It will be understood that the claims are intended to cover all changes and modifications of the preferred embodiments of the invention, herein chosen for the purpose of illustration which do not constitute departures from the spirit and scope of the invention.

What is claimed is:

1. In combination with a paperback book having a spine, two flexible flaps and a plurality of pages, a book cover comprising:

(a) a main panel;

(b) first and second longitudinal peripheral flaps folded toward each other along opposed edges of said main panel;

(c) four slits in said paperback book at the junction of the outer perimeter of the spine and flexible flap parallel to said junction;

(d) said first longitudinal peripheral flap being fitted into one pair of said slits and enclosing one edge of both of said flexible flaps;

(e) said second longitudinal peripheral flap being fitted into the other pair of said slits and enclosing the other edge of both of said flexible flaps; and (f) means for closing the opposed ends of said main panel and first and second longitudinal peripheral flaps whereby said flexible flaps are captured therein.

2. The combination recited in claim 1 further comprising at least one reinforcing board having its opposed edges enclosed by said first and second longitudinal peripheral flaps, said at least one reinforcing board being located between one of said flexible flaps and said pages.

3. The combination recited in claim 2 further comprising a second reinforcing board having its opposed edges enclosed by said first and second longitudinal peripheral flaps, said second reinforcing board being located between the other of said flexible flaps and said pages.

4. The combination recited in claim 2 further comprising:

(a) said at least one reinforcing board being glued to said first and second longitudinal flaps; and (b) a first of said opposed ends being folded over and glued to said reinforcing board whereby an envelope-type pocket is formed.

5. A method of covering a paperback book of the type having a spine, a plurality of pages and front and back flexible flaps joined to said spine comprising:

(a) slitting said flexible flaps adjacent each of the four corners of said spine;

(b) inserting opposed longitudinal peripheral flaps attached to a main panel into said four slits whereby said main panel overlies said flexible flaps and said longitudinal peripheral flaps each enclose one edge of said front and back flexible flaps; and (c) closing the opposed ends of said main panel whereby said flexible flaps are captured.

6. The method recited in claim 5 further comprising inserting one reinforcing board between one of said flexible flaps and said pages, the edges of said reinforcing board being enclosed by said first and second longitudinal flaps.

7. The method recited in claim 6 further comprising inserting a second reinforcing board between the other of said flexible flaps and said pages, the edges of said second reinforcing board being enclosed by said first and second longitudinal flaps.

8. The method recited in claim 5 wherein the steps of closing one of the opposed ends comprises before covering the book, performing the steps of:

(a) gluing a reinforcing board to the inside of said longitudinal peripheral flaps near one end thereof;

(b) folding the end of said panel over said reinforcing board; and (c) gluing the folded end of said panel to the reinforcing board whereby an envelope-type pocket is formed.

9. The method recited in claim 8 further comprising sliding one of said flexible flaps into said pocket until the inner edge of said reinforcing board abuts said spine.

10. The method recited in claim 9 further comprising:

(a) sliding a second reinforcing board between the other of said flexible flaps and said opposed longitudinal flaps until the inner edge of said second reinforcing board abuts said spine; and (b) folding the other end of said panel over the outer edge of said second reinforcing board whereby said front and back flexible flaps are captured.

* * * * *